United States Patent [19]

Jacobs

[11] 4,133,238

[45] Jan. 9, 1979

[54] FOOD-HANDLING DEVICE

[76] Inventor: Jacob L. Jacobs, 2628 - Youngstown-Lockport Rd., Ransomville, N.Y. 14131

[21] Appl. No.: 812,488

[22] Filed: Jul. 5, 1977

[51] Int. Cl.[2] ..... B26D 7/00

[52] U.S. Cl. ..... 83/762; 83/466.1

[58] Field of Search ..... 83/761, 762, 763, 764, 83/466.1, 467

[56] References Cited

U.S. PATENT DOCUMENTS

| | | | |
|---|---|---|---|
| 709,553 | 9/1902 | Morrison | 83/762 |
| 1,554,638 | 9/1925 | McLeod | 83/762 |
| 2,649,658 | 8/1953 | Nelson | 83/761 |
| 3,971,273 | 7/1976 | Peters et al. | 83/762 X |

*Primary Examiner*—Willie G. Abercrombie

*Attorney, Agent, or Firm*—Ashlan F. Harlan, Jr.

[57] ABSTRACT

A device for holding a sandwich during cutting thereof and/or during insertion thereof in a container which device comprises a tray having opposed, spaced, side walls, each provided with a vertical slot extending from its top edge substantially to its bottom. Said slots are adapted to receive a knife blade for cutting a sandwich reposing in said tray. The side walls, adjacent one end of the tray, are provided with inturned extensions that partially close said end. At the same end, the bottom of the tray extends outwardly, parallel to said side walls, and is preferably provided with an upwardly projecting end. The device also includes a separable end plate, generally rectangular in shape that is of slightly less length than the distance between said side walls and which is provided with longitudinally projecting hooks at its ends adapted to loosely engage said side walls.

6 Claims, 4 Drawing Figures

FOOD-HANDLING DEVICE

BACKGROUND OF THE INVENTION

This invention relates to food-handling devices and is particularly concerned with a device for holding a sandwich during cutting thereof and/or during the packing or insertion of the sandwich in a container.

One of the most widely used comestibles is the sandwich. Millions of sandwiches are made and consumed each day. They are made with all types of bread and a virtually infinte number of different fillings. Since many sandwiches are packed in lunches to be carried to school, work, or a place for recreation, it is necessary in many cases to pack the sandwich in a container to preserve its freshness and keep it intact. While in the case of a simple sandwich, such as the traditional "ham on rye", such packing usually presents no problems, when thicker, more particulate fillings, such as egg salad, are used or when composite sandwiches such as "club" sandwiches are concerned, it has often been found to be quite difficult to insert the sandwich in a container, e.g. a bag or box, without destroying its integrity. Insertion of a sandwich into a bag or end-opening box is particularly troublesome when the sandwich has been cut into segments.

It is an object of the present invention to provide a device which makes it easy to handle sandwiches, to cut them into segments, and to insert them conveniently, either cut or uncut, into a bag or an end-opening box while maintaining them in shape.

SUMMARY OF THE INVENTION

The above-mentioned object is accomplished by the present invention which comprises a tray of such size as to contain a sandwich and having opposed, spaced, side walls. Each of the side walls is provided with a vertical slot extending from its top edge to substantially the bottom thereof, said slots being so placed that a sandwich contained in the tray may be cut into segments of appropriate and desired size and shape by a knife extending through the slots. Adjacent one end of the tray, the side walls are provided with extensions that partially close said end. These extensions are preferably normal to and integral with the side walls. At the same end, the bottom of the tray extends outwardly, parallel to said side walls and is preferably provided with an upwardly projecting outer edge that serves as a gripping portion or handle. Associated with the above-described tray is a separable end plate, the body portion of which is slightly shorter than the distance between the side walls of the tray. The plate is provided with longitudinally projecting hooks at its ends that loosely engage over said side walls. Thus, the end plate is freely movable lengthwise of the tray. Accordingly, as more particularly set forth hereinafter, a sandwich placed in the tray may be cut into segments by a knife operating in the slots of the tray side walls and may then be pushed from the tray into a bag or other container by the end plate. It is not necessary to pick up the sandwich segments and, therefore, there is less chance of disturbing the contents or having the filling fall out.

SHORT DESCRIPTION OF THE DRAWINGS

THE INVENTION

Figure 1:
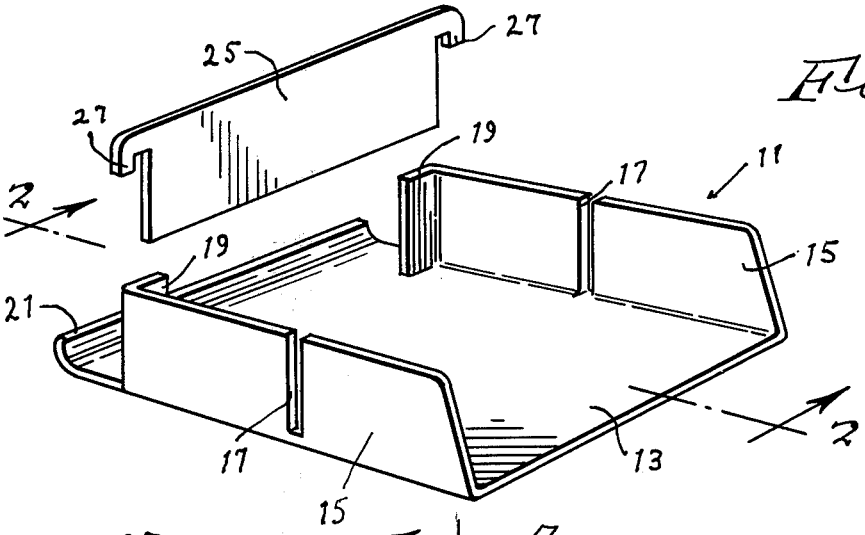
FIG. 1 is a perspective view of one embodiment of the present invention.

As briefly mentioned above, the present invention comprises a tray 11 having a base or bottom 13 and upstanding side walls 15. Each of the latter is provided with a slot 17 that extends from the upper edge thereof to substantially the base 13. As shown, the slots 17 are aligned so that a line drawn through both of them would be substantially normal to and about midway of the side walls 15. However, the slots can, if desired, be so located as to cause such a line to be at any desired angle with the side walls and, if desired, more than one slot can be provided in each wall. Adjacent one end of the tray 11, extensions 19 of the side walls 15 project inwardly, preferably substantially normal to the side walls, partially to close said end. The extensions 19 are preferably formed integrally with or are firmly secured to both the side walls 15 and the base 13 of the tray 11. The bottom 13 of the tray extends outwardly, parallel to said side walls 15, a short distance and the end thereof is preferably bent upwardly, as shown at 21. There is thus provided a gripping portion or handle for the tray.

A separable, generally rectangular, end plate 25 is provided. The plate 25 is slightly shorter than the distance between the side walls 15 and is furnished with hooks 27 which are preferably integral and that project longitudinally thereof from its upper corners and are adapted to engage loosely over said side walls so that the plate may move freely lengthwise of the tray 11 but is retained in the tray by the wall extensions 19 at one end of the tray. Because of the hooks 27, when in use the plate 25 is maintained substantially normal to the side walls 15.

Figure 2:
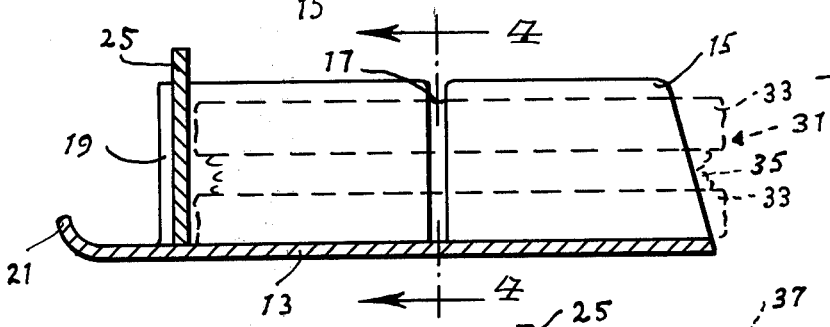
FIG. 2 is a longitudinal sectional view, taken on the line 2—2 of FIG. 1 of the embodiment illustrated in FIG. 1.
Figure 3:
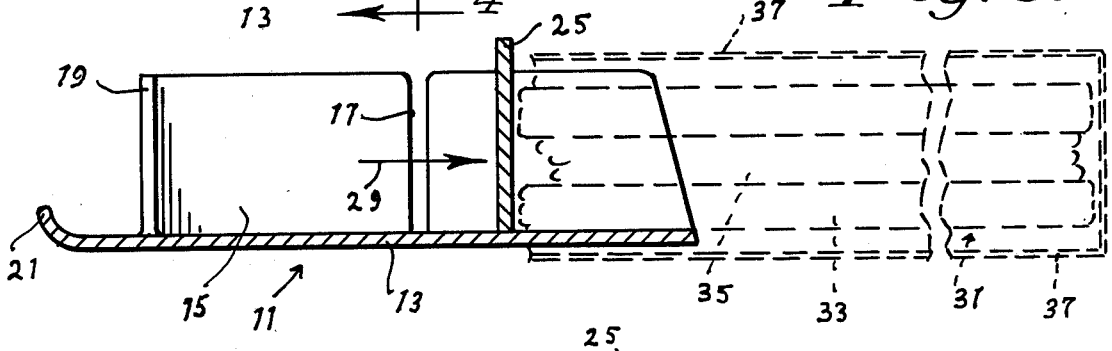
FIG. 3 is a longitudinal view similar to FIG. 2 showing a sandwich being inserted into a bag.
Figure 4:
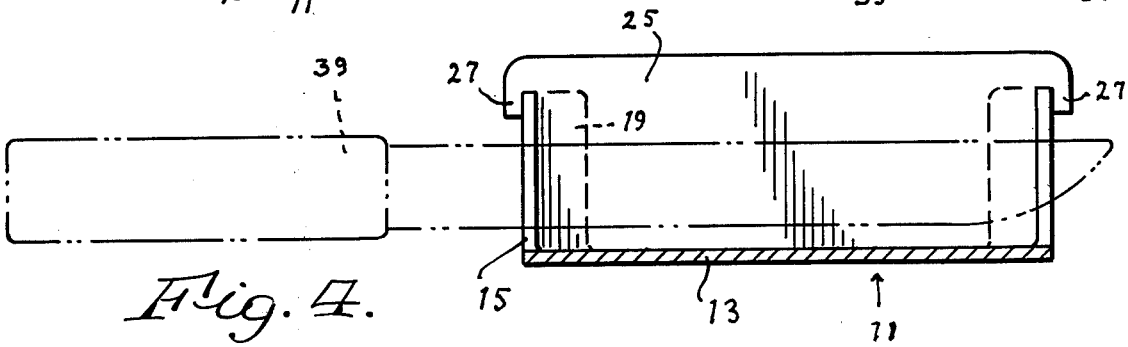
FIG. 4 is a transverse sectional view, taken on line 4—4 of FIG. 2, showing the way in which a knife is employed to segment a sandwich.

The use of the device of the present invention is indicated in the accompanying drawings. FIG. 2 shows a sandwich 31 comprising two slices of bread 33 and a filling 35, in the tray 11 with the end plate 25 of the device located against the wall extensions 19. In FIG. 3 the sandwich 31 is being pushed, in the direction of the arrow 29, by the end plate 25, which can be grasped at the top by the fingers of the user, into a bag 37. As shown, this is facilitated by first inserting the open end of the tray 11 into the bag while holding the tray by the handle 21. FIG. 4 illustrates the use of a knife 39, the blade of which is inserted in the slots 17 of the walls 15 to cut the sandwich before it is loaded into the bag, if such cutting is desired.

It will be understood that, if desired, modifications of the above-described structure and changes in the operations performed may be made without departing from the spirit of the invention. For example, instead of having the base or bottom 13 of the tray extend outwardly beyond the wall extensions 19, a handle of a different type can be provided to hold the tray while a sandwich is being removed from the tray the the end plate 25. Also, the slots in the side walls 15 can be, if desired, disposed so that the sandwich may be cut diagonally instead of squarely. Indeed, slots to permit both square and diagonal cutting can be provided. Further, more than one cut can be made on a sandwich, if desired, by merely shifting the sandwich in the tray. It will be observed that the open end of the tray is shown with bevels on the ends of the side walls 15. This tends to make entry of the tray into a bag easier. The angle of the bevels may be varied as desired. However, as indicated above, a tray according to the present invention can be used also to insert sandwiches in open-end boxes and is useful merely to hold a sandwich during cutting when the sandwich is not to be packed at all.

The device of the present invention can be constructed in various sizes and may be made of many different materials. It is desirable, however, to use a material which is easily kept sanitary and which is strong enough to minimize breakage and the abrasive action of a knife used to cut sandwiches held therein. Accordingly, stainless steel, aluminum, and certain resistant plastic materials such as nylon will be found to be particularly suitable for its construction.

I claim:

1. A food-handling device suitable for holding a sandwich and for assisting in the insertion of a sandwich into an open-ended container which comprises a generally rectangular tray, said tray having a bottom, opposed, fixed, upstanding side walls, and open ends; each of said side walls having, adjacent one of said ends, an inwardly-directed extension, partially closing said one end, said extensions being laterally aligned, and each of said side walls having a vertical slot extending from the top thereof to substantially the bottom thereof between said inwardly-directed extension and the other end, said slots being adapted to receive the blade of a knife, and said side walls at said other ends being bevelled whereby to facilitate entry of said tray into a container; and a detached end plate adapted to fit between said side walls and engage said extensions and movable lengthwise of said tray between said side walls to expel a sandwich from said tray into said container.

2. A device as defined in claim 1 wherein said tray is provided with a handle on the exterior of said partially closed end.

3. A device as defined in claim 2 wherein said handle comprises an extension of said bottom.

4. A device as defined in claim 3 wherein said bottom extension has a bent end.

5. A device as defined in claim 1 wherein said end plate is substantially rectangular and is provided with longitudinally directed hooks on its upper corners for engagement with said side walls.

6. A device as defined in claim 5 wherein said hooks are formed integrally with said end plate.

* * * * *